ary chamber selected for supply with driving fluid under pressure before the end or at the end of both strokes of the movable jack member.

2. Saving device as claimed in claim 1, wherein said valve members are selectively opened and kept open by the pressure of the fluid in the secondary chamber in the exhaust phase and closed up, when said pressure disappears, by an elastic member.

3. Saving device as claimed in claim 1, wherein said valve members are selectively opened and kept open by the pressure in the secondary chamber in the exhaust phase and closed up, when said pressure disappears, by the pressure of the driving fluid.

4. Saving device as claimed in claim 1, wherein said device comprises means for controlling the position of said valve members so as to control the flow of fluid under pressure and the speed of the movable jack member.

5. Saving device as claimed in claim 1, wherein each said valve member is associated with a secondary chamber and wherein each said seat member is associated with one of said valve members and is adapted to occupy selectively a closing position relative to a respective associated valve member under the pressure of the driving fluid and each said valve member is adapted to occupy selectively an open position under the pressure of fluid from the respective unassociated secondary chamber.

6. Saving device as claimed in claim 1, wherein said valve members open under the pressure of the driving fluid and wherein said device further comprises a position sensor for providing a pneumatic signal, said valve members closing by the pressure of the driving fluid provided in response to the pneumatic signal provided by the position sensor corresponding to a position of the movable jack member, before the end or at end of a stroke thereof.

7. Saving device as claimed in claim 5, wherein the position sensor senses the movement of the movable jack member.

8. Saving device as claimed in claim 5, wherein the position sensor senses the end of the stroke of the movable jack member.

9. Saving device as claimed in claim 6, wherein position sensor comprises a pressure-drop sensor for delivering a pneumatic signal when a drop of pressure occurs in the jack on the exhaust side thereof.

10. Saving device as claimed in claim 6, wherein the pneumatic signal is issued from a circuit associated to the movement of another jack which initiates said pneumatic signal immediately when the first controlled jack reaches the end of a stroke thereof.

11. Saving device as claimed in claim 6, wherein said device comprises a body having a pneumatic control circuit integrated to said body for providing the pneumatic signal.

12. Saving device as claimed in claim 1, wherein said device comprises a body in which is mounted said valve members, each said valve member controlling an orifice in an associated said seat member forming a passageway between respective secondary chambers and a fluid distributor.

13. Saving device as claimed in claim 12, wherein each valve member has a closing member for cooperating with said orifice in said associated seat member, said valve and seat members being mounted for sliding inside cylinders in the body, and wherein said valve member includes a piston subjected on its two faces to the action of an elastic member and of fluid under pressure.

14. Saving device claimed in claim 12, wherein each valve member has a closing member for cooperating with said orifice in said associated seat member, said valve and seat members being mounted for sliding inside cylinders in the body, and wherein said valve member includes a piston subjected on its two faces to the action of fluid under pressure.

15. Saving device as claimed in claim 1, wherein a body contains said valve members and is mounted between a distributor and a base member with said body contacts by two of its faces, said base member having integrated channels and making the communication, on the one hand, with pipes issuing on one of the faces of said body and, on the other hand, with the jack and fluid admission and exhaust pipes, said body being provided on another face thereof with pipe orifices situated opposite orifices of pipes of the distributor.

16. Saving device as claimed in claim 15, wherein said device further comprises two valve members of the open type for controlling the flows of driving fluid and exhaust fluid, each valve member being subjected to the action of a spring and including a rod having an end mounted for sliding inside a blind hole of a piston subjected on one of its faces having a larger cross-section to the combined action of a spring and exhaust pressure and on another face of smaller cross-section to the pressure of the driving fluid.

17. Saving device as claimed in claim 15, wherein said device further comprises two valve members of the open type for controlling the flows of driving fluid and exhaust fluid, each valve member being subjected to the action of a spring and including a rod having an end mounted for sliding inside a blind hole of a piston subjected on one of its faces having a larger cross-section to the combined action of a spring and exhaust pressure and on the another face of smaller cross-section to the action of a pneumatic signal issued by a sensor of the position of the movable jack member and to the pressure of the driving fluid.

18. Saving device as claimed in claim 15, said device further comprising two non-return valves for controlling the flow of exhaust fluid from the secondary chambers.

19. Saving device as claimed in claim 18, wherein the valves members are of the open type and comprise obdurating members mounted for sliding inside the body and are integral with pistons subjected on one face to the combined action of a spring and the pressure of exhaust fluid and on the other face to the action of the pressure of the driving fluid, said spring having just enough strength to keep the valve members open when there is no pressure on the other face of the piston.

20. Saving device as claimed in claim 18, wherein the valve members are of the open type and comprise obdurating members integral with pistons subjected on one face to the action of a spring for opening the respective valve member and on the other face to the action of a pneumatic signal for closing the valve, said signal being issued by a sensor of the position of the movable jack member.

21. Saving device as claimed in claim 1, wherein said device comprises a dual-connector body containing two saving assemblies disposed in parallel, each comprising at its two ends fluid passageways provided with means for connecting them with outside pipes, said body being provided in its center with two bores perpendicular to

LOCKING CIRCUIT FOR HYDRAULIC SYSTEMS

TECHNICAL FIELD

This invention relates to hydraulic systems having an output work actuator such as a hydraulic fluid actuator or cylinder, and more particularly to a hydraulic system having a locking circuit for retaining a fluid actuator in a fixed, load-supporting condition.

BACKGROUND OF THE INVENTION

Heavy duty construction and earth moving implements such as excavators, cranes, backhoes, loaders and like material handling devices, rely in large measure on hydraulic systems as the motive force to effect their various work functions. In most cases, the output or actuating device of the system is a hydraulic fluid actuator or cylinder (sometimes referred to as a fluid ram) linked directly to the particular working apparatus, such as a loader bucket, a backhoe boom, or the like. The hydraulic pressures utilized in systems of the type discussed typically are quite high, being of the order of 2,000 to 3,000 psi, and under normal operating conditions, the rated hydraulic pressures of a given system are adequate and sufficient to perform the intended operations. Control over the applied pressure is obtained with selectively operable directional control valves which direct pressurized fluid flow from one or more associated hydraulic fluid pumps.

Workers skilled in the art will recognize that the implements frequently are operated in modes or positions which can tax even the maximum rated pressure of the system, such as when "craning" with an upraised heavy load. For example, during the typical operation of a backhoe or loader, the bucket of the implement may be filled with or attached to a load, and then moved to an extended or upraised position. Frequently, the implement in that condition is then required to travel some distance before releasing the load. If, as is often the case, the ground over which the implement must travel is bumpy or uneven, the shocks and jolts transmitted to the extended and loaded bucket can well create fluid pressure forces approaching the maximum rated pressure of the hydraulic system. Under such conditions, failure of a hydraulic fluid line or other component could result in undesired loss of control of the supported load. Even if the load forces are not excessive, the normal hydraulic fluid control valves may be unable to provide the desired degree of accuracy of hydraulic fluid flow control during such operations.

There thus exists a need for a means to accommodate operation of an implement's hydraulic system at high load levels while maintaining desired control of a supported load. More specifically, there is a need for means capable of selectively locking the system into a load-supporting condition so that temporary overload conditions will have no appreciable effect on the implement or the work function then being performed.

SUMMARY OF THE INVENTION

The present invention provides an arrangement for hydraulic systems which can be selectively activated to lock a fluid actuator of the system in a load-supporting condition to thereby prevent unintended movement of a supported load. As will be recognized, the present invention can be readily provided in association with existing hydraulically-operated components of a material handling implement, such as a front-end loader, backhoe, or the like.

In general, the invention comprises a spring-loaded normally open check valve in parallel flow relation with a pressure relief valve located in close proximity to the port of a hydraulic fluid actuator or cylinder which is pressurized attendant to support of a work load. The check valve is configured to close in response to a pressure differential across the valve which acts in opposition to and is sufficient to overcome the spring-urging of the valve to its open condition.

In the same hydraulic circuit, there is positioned a selectively operable quick-release valve in parallel flow relation with the system's main directional control valve with respect to the system's fluid tank or reservoir. The directional control valve is normally operable for selectively directing pressurized hydraulic fluid to the hydraulic fluid actuator. The quick-release valve is positioned downstream of the check valve with relation to the hydraulic actuator port so that when activated, the quick-release valve causes a pressure drop downstream of the check valve sufficient to cause closing of the check valve. In other words, activation of the quick-release valve creates a pressure differential across the check valve which causes it to close. In this condition, fluid flow from the associated actuator port is prevented and the actuator is locked in its load-supporting position, with the pressure relief valve of the system opening in the event that load fluid pressures exceed the rated capacity of the actuator. Return of the system to the normal operating mode is achieved by simply activating the main control valve which causes the spring-loaded check valve to again open.

In the event of line rupture downstream from the check valve, a similar pressure drop is experienced. Thus, the invention automatically locks the hydraulic fluid actuator in its load-supporting position in the event of accidental line rupture or the like.

Other features and advantages of the invention will be apparent from the following description and claims and are illustrated in the accompanying drawings which show structure embodying the preferred features of the present invention and the principles thereof.

DETAILED DESCRIPTION OF THE INVENTION

Figure 1:
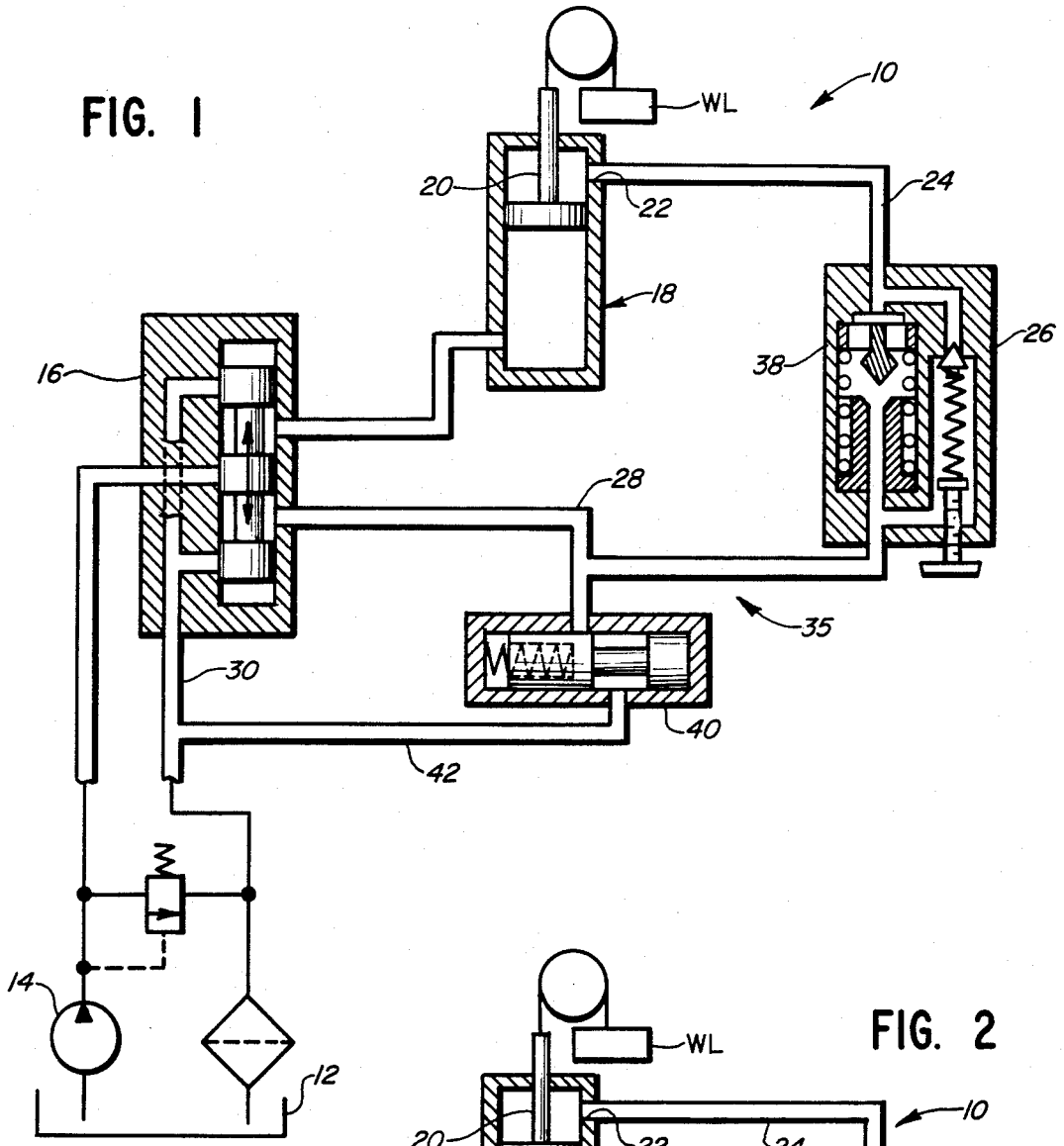
FIG. 1 is a schematic circuit diagram showing the present hydraulic system in a pressure-equalized operating condition with a work load being supported by a hydraulic fluid actuator.

While the present invention is susceptible of embodiment in various forms, there is shown in the drawings and hereinafter described a presently preferred embodiment of the invention, with the understanding that the present disclosure is to be considered as an exemplification of the invention and is not intended to limit the invention to the specific embodiment illustrated.

Referring with greater particularity to the various drawings, it will be seen that the reference numeral 10 indicates generally a simplified hydraulic system having incorporated therein a locking circuit embodying the principles of the invention. Hydraulic system 10 comprises a conventional circuit including a fluid tank 12, a pump 14 for pressurizing fluid from the tank, and a main control valve 16 for directing pressurized fluid flow. The pump 14 is operatively connected via control valve 16 to a work output hydraulic cylinder or actuator 18. The piston 20 of said actuator is connected to, and adapted to move and support, a work load designated WL. The components thus described would be typical of the arrangement for operating a front-end loader, a backhoe, or like material handling device.

The actuator 18 typically comprises a pair of fluid ports which can be selectively pressurized attendant to operation of control valve 16 for operating the actuator. The one of the ports which is pressurized attendant to support of work load WL (i.e., the "rod end" of the actuator in the illustrated embodiment) is designated hereinafter as return or equalization port 22. Port 22 communicates through return line 24 with a pressure relief valve 26. Pressure relief valve 26 communicates serially through return line 28 with the control valve 16, with the control valve completing the circuit back to the tank 12 through return line 30.

In accordance with the present invention, hydraulic system 10 comprises a locking circuit generally designated 35. Locking circuit 35 comprises a spring-loaded and normally open check valve 38 in parallel flow relation with the pressure relief valve 26. Check valve 38 is connected at its upstream end to the return line 24 and at its downstream end to the return line 28. As illustrated, check valve 38 can be integrally joined with relief valve 26, with the valves preferably provided in close proximity to port 22 such as by mounting on actuator 18. This minimizes that chance of a fluid line failure between port 22 and check valve 38.

The check valve 38 is arranged to close in opposition to its biasing spring in response to a pressure differential across the valve. The orifice of the check valve and its spring are sized such that under normal operation, the maximum anticipated flow will not create enough of a pressure differential across the orifice to overpower the spring and close the valve.

In order to effect selective closing of check valve 38, quick-release valve 40 is connected in parallel flow relation with the control valve 16 with respect to the fluid tank 12, with the quick-release valve being connected at its upstream end to the return line 28 and at its downstream end to the return line 30 to the tank through an additional return line 42. The quick-release valve 40 can be spring-loaded and is preferably adapted to quickly return to its normally closed position (see FIGS. 1, 3, and 4) after operation thereof by suitable means which may be manual or electrical. In essence, the quick-release valve 40 permits release of fluid pressure in line 28 so that a pressure differential is created across check valve 38 to close the check valve, thus locking actuator 18 in its load-supporting condition.

Operation of the invention may now be appreciated by reference to the drawings in sequence. In FIG. 1, the actuator cylinder 18 has been placed in the desired load-supporting condition for support of the work load WL by appropriate manipulation of the main control valve 16. The system is now in a state of equilibrium, with hydraulic pressure in lines 24 and 28 being a function of the supported work load WL. Check valve 38 is in its open condition, with no significant pressure differential existing across the check valve.

Figure 2:
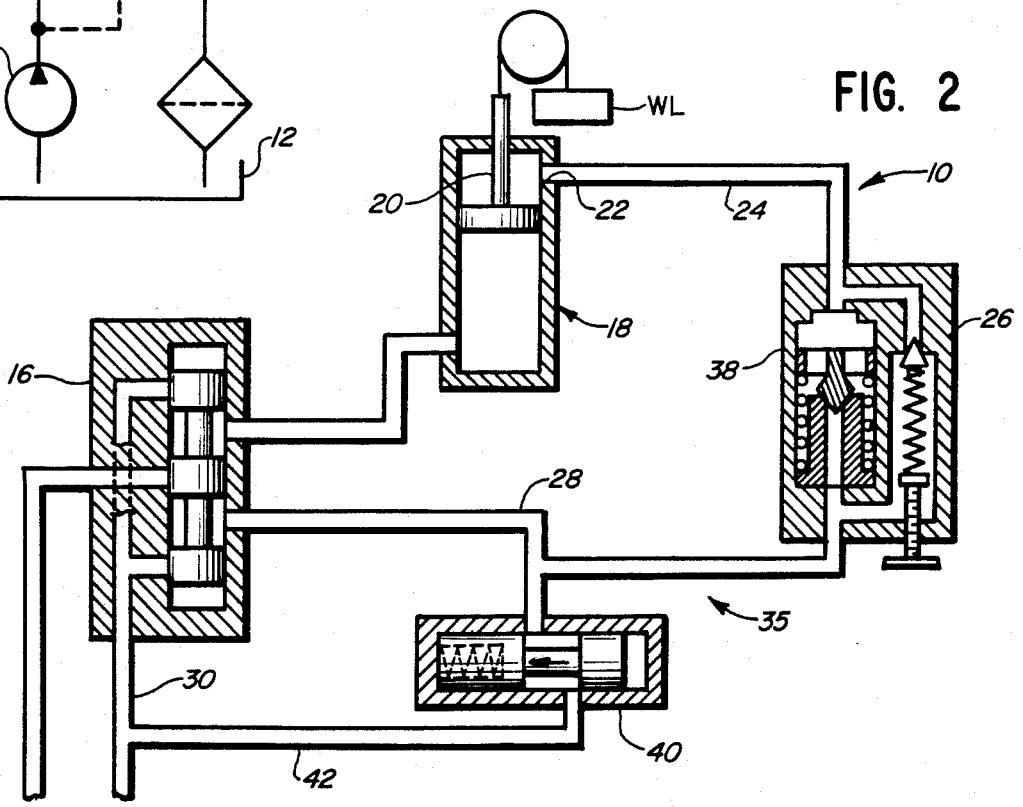
FIG. 2 is a similar view showing the relationship of elements after opening of a quick-release valve of the system for locking the fluid actuator in its load-supporting condition.

With the control valve 16 still in the neutral position, the quick-release valve 40 is activated and opened as shown in FIG. 2. This opening of the quick-release valve 40 causes a temporary pressure drop in the return line 28 downstream of the check valve 38. The differential pressure across the check valve 38 is sufficient to overcome the force of its spring and thus closes the check valve to prevent further fluid flow from the cylinder port 22. The fluid actuator 18 is thereby locked into the desired load-supporting condition. The amount of fluid flow released by the described actuation of the quick-release valve 40 equals the small volume between the poppet and seat of the check valve 38 and thus is generally negligible.

Figure 3:
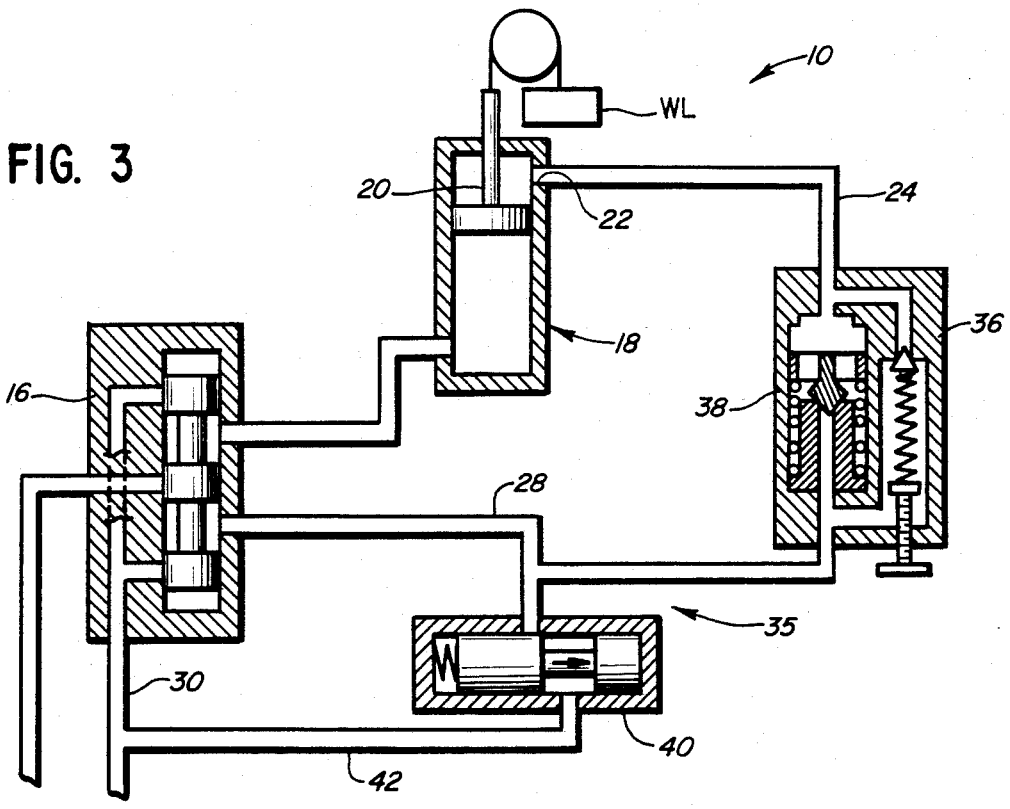
FIG. 3 is a similar view showing the locked condition as the quick-release valve has self-returned to its normal closed position.

When the quick-release valve 40 is itself released, it is spring-urged back to its normally closed position as shown in FIG. 3. The fluid actuator 18 remains locked in its load-supporting position and the special operations described, such as craning or ground travel, can take place without movement of the actuator. The normally closed pressure relief valve 26 allows actuator 18 to move only under such conditions when induced fluid pressure in the actuator might cause internal failure.

Figure 4:
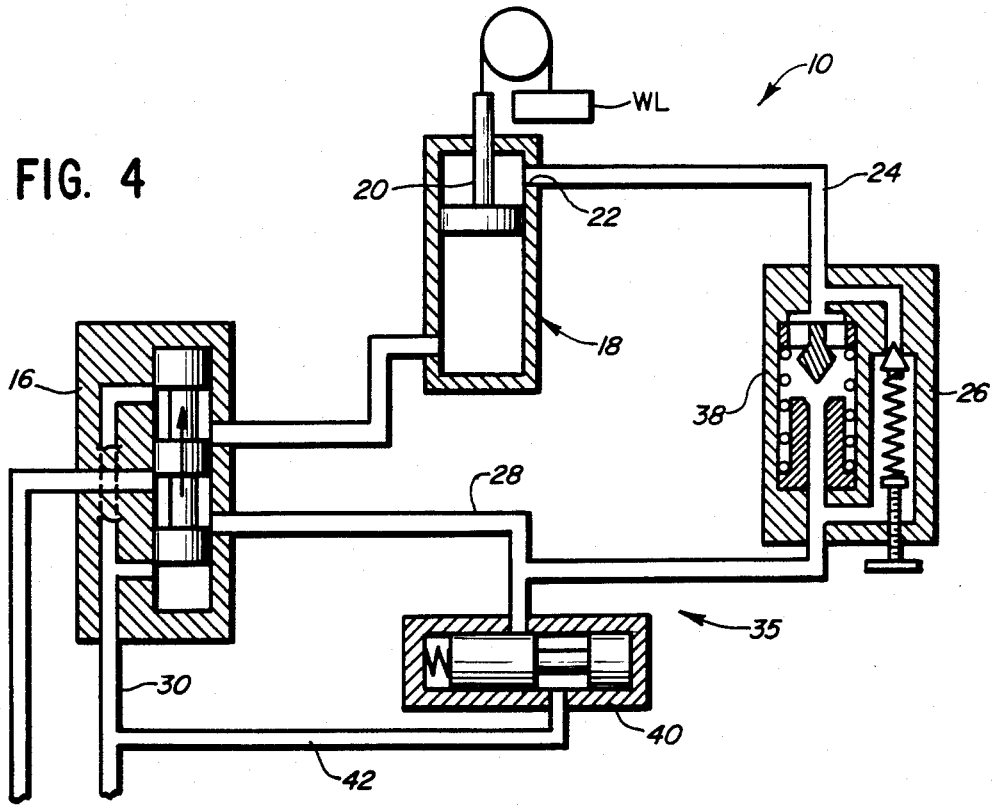
FIG. 4 is a similar view showing opening of the check valve and return to normal operating condition upon opening of the system's main control valve.

The actuator 18 is easily unlocked at the conclusion of the special operations by simply activating the main control valve 16 to equalize the pressure on both sides of the spring-loaded check valve 38, which allows the spring force to once again hold open the check valve as shown in FIG. 4. As noted, check valve 38 is configured such that under normal operating conditions the maximum anticipated fluid flow will not create a sufficient pressure differential across the valve orifice to overcome the spring and close the valve.

As described, the closing of the check valve 38 and locking of the fluid actuator 18 is initiated by the temporary pressure drop downstream of the check valve 38 by activation of quick-release valve 40. Such a pressure drop will of course likewise occur in the event of line breakage or rupture at any point in the return line 28. It will thus be appreciated that locking circuit 35 automatically functions additionally to lock the fluid actuator 18 in a load-supporting condition in the event of a fluid line failure.

While a preferred embodiment of the invention has been illustrated and described herein, it will be appreciated that changes and variations may be made by those skilled in the art without departing from the spirit and scope of the appended claims. The invention is defined by the claims that follow.

What is claimed is:

1. In an hydraulic system including a fluid tank, pump means for pressurizing fluid from the tank, control valve means for directing pressurized fluid flow, and a work fluid actuator operatively joined to said valve means and having a fluid return port, the improvement comprising:

pressure relief valve means downstream of said return port;

spring-urged normally open check valve means in parallel flow relation with said relief valve means, said check valve means closing in response to a fluid pressure differential across the check valve means acting in opposition to said spring-urging of said check valve means; and selectively operable pressure release means downstream of said check valve means in parallel flow relation with said control valve means with respect to said tank, whereby activation of said pressure release means causes closure of said check valve means preventing fluid flow from the return port of said actuator through said check valve means and thereby locking the actuator in a fixed position.

2. The improvement according to claim 1 wherein said pressure release means comprises a spring-urged normally closed release valve adapted to return quickly to its normally closed position after activation.

3. A locking circuit for a hydraulic system having a work fluid actuator, comprising:

spring-urged normally open check valve means in fluid communication with said actuator and downstream thereof; and pressure release valve means downstream of said check valve means and in fluid communication therewith, said pressure release valve means being selectively operable to relieve fluid pressure downstream of said check valve means to create a pressure differential across said check valve means to cause closure of said check valve means to prevent fluid flow from said fluid actuator and thereby lock said actuator in a fixed position.

4. A locking circuit according to claim 3, wherein said pressure release valve means comprises a spring-urged normally closed release valve adapted to return quickly to its normally closed position after operation thereof to provide said pressure relief.

5. A hydraulic system for material handling implements or the like, comprising:

a fluid tank;

pump means for pressurizing fluid from said tank;

control valve means operatively connected to said pump means for regulating the flow of fluid through the system;

a hydraulic fluid work actuator in fluid communication with the control valve means and including a fluid return port;

a pressure relief valve communicating with said return port and downstream thereof;

a fluid return line connected between said pressure relief valve and the control valve means;

hydraulic fluid locking means connected between said return port and said fluid return line and in parallel flow relation with said pressure relief valve; and pressure release means communicating with said fluid return line and operable to close said locking means and thereby lock said fluid actuator in a fixed position.

6. An hydraulic system according to claim 5, wherein said locking means comprises a spring-urged normally open check valve adapted to be closed by a pressure drop downstream thereof.

7. An hydraulic system according to claim 6, wherein said pressure release means comprises a spring-urged normally closed release valve adapted to return quickly to its normally closed position after operation thereof, said release valve being in parallel flow relation with said control valve means with respect to said fluid tank, said release valve being operable to create a pressure differential across said check valve for closing said check valve.

* * * * *